US008013878B2

(12) United States Patent
Kim

(10) Patent No.: US 8,013,878 B2
(45) Date of Patent: Sep. 6, 2011

(54) APPARATUS FOR AUTOMATICALLY SETTING OVER-DRIVING LOOK-UP TABLE FOR LIQUID CRYSTAL DISPLAY DEVICE AND CONTROL METHOD THEREOF

(75) Inventor: Ki Duk Kim, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 908 days.

(21) Appl. No.: 11/979,460

(22) Filed: Nov. 2, 2007

(65) Prior Publication Data

US 2008/0204482 A1 Aug. 28, 2008

(30) Foreign Application Priority Data

Feb. 28, 2007 (KR) ..... 10-2007-0020544

(51) Int. Cl.
*G09G 5/10* (2006.01)

(52) U.S. Cl. ..... 345/690; 345/89

(58) Field of Classification Search ..... 345/89, 345/690

See application file for complete search history.

(56) References Cited

U.S. PATENT DOCUMENTS

| | | | | |
|---|---|---|---|---|
| 7,184,001 | B2 * | 2/2007 | Chen | 345/3.2 |
| 2004/0223007 | A1 * | 11/2004 | Mamata | 345/690 |
| 2004/0263450 | A1 * | 12/2004 | Lee et al. | 345/87 |
| 2005/0264506 | A1 * | 12/2005 | Kim | 345/87 |
| 2007/0176871 | A1 * | 8/2007 | Tsai et al. | 345/89 |

FOREIGN PATENT DOCUMENTS

CN 1576869 2/2005

* cited by examiner

*Primary Examiner* — Chanh Nguyen
*Assistant Examiner* — Kwang-Su Yang
(74) *Attorney, Agent, or Firm* — McKenna Long & Aldridge LLP

(57) ABSTRACT

An over-driving look-up table automatic setting apparatus for a liquid crystal display device includes: an input device that specifies a critical response condition for a liquid crystal display device; a sensor that detects an amount of light from the liquid crystal display device and that generates a signal corresponding to the amount of light; a response state detecting unit that measures the response state from the signal generated by the sensor; a controller that receives the response state for gray scale differences from each of a plurality of gray scale values to determine transient pixel data producing a response state that satisfies the critical response condition and that sets an over-driving look-up table by mapping the transient pixel data to corresponding gray scale difference values for each gray scale value; and a memory that stores the over-driving look-up table.

14 Claims, 4 Drawing Sheets

APPARATUS FOR AUTOMATICALLY SETTING OVER-DRIVING LOOK-UP TABLE FOR LIQUID CRYSTAL DISPLAY DEVICE AND CONTROL METHOD THEREOF

This application claims the benefit of Korean Patent Application No. 10-2007-0020544, filed on Feb. 28, 2007, which is hereby incorporated by reference for all purposes as if fully set forth herein.

BACKGROUND OF THE INVENTION

1. Field of the Invention

The present invention relates to a manufacturing equipment of a liquid crystal display (LCD) device, and more particularly, to an apparatus for automatically setting an over-driving look-up table to be stored in a memory device included in an LCD device, and a control method thereof.

2. Discussion of the Related Art

A typical LCD device controls light transmittance of liquid crystal (LC) in response to video data to display an image corresponding to the video data. LCD devices may form display screens of nearly unlimited size. In addition, LCD devices may be manufactured with slim profiles and light weights. Accordingly, LCD devices may be used as a display device for computers and television receivers as a substitute for cathode ray tube (CRT) display devices.

An LCD device applies pixel driving signals (or voltages) corresponding to a gray scale to LC cells arranged in a matrix configuration. LC molecules included in each LC cell are aligned in a direction corresponding to a potential difference between a pixel driving signal and a reference voltage (or common voltage). An amount of light passing through the LC cell varies according to the alignment directions of LC molecules allowing an image to be displayed.

Depending on the particular physical operation mode (for example, the direction of rotating motion) of LC molecules in an LCD device, the response time, which is a period of time for forming an image upon application of corresponding video data, may be relatively slow. As a result, a motion blurring phenomenon where the outline of an object is blurred and a ghost phenomenon are generated in moving images displayed by an LCD device.

To prevent generation of the motion blurring phenomenon and the ghost phenomenon, an over-driving algorithm is applied in driving the LCD device with video data. The over-driving algorithm uses an transient pixel driving signal with a gray scale having a greater difference than a difference between a previously supplied gray scale and a currently supplied gray scale to be applied to an LC cell for a predetermined time (i.e., one frame period) when an image changes (i.e., the gray scale of a pixel to be displayed by the LC cell changes between frames). The speed of physical operation of LC molecules contained in an LC cell is increased by using the transient pixel driving signal having a greater gray scale than the gray scale of the originally supplied pixel data, thus improving the response time of an LCD device. In addition, to allow an LCD device to have a constant response time regardless of the frame to frame differences in gray scale for a pixel, a difference between a gray scale that and a gray scale of a transient pixel driving signal may be increased as the frame to frame difference in gray scales changes.

As one alternative for implementing an over-driving circuit construction, an LCD device uses an over-driving look-up table in which transient pixel driving data having various gray scale differences for a pixel depending on the frame to frame variation in pixel gray scale. The gray scales of transient pixel data contained in the over-driving look-up table are modified depending on the physical property of the liquid crystal, the design specification of an LCD device, and the particular model for the LCD device.

To prepare the over-driving look-up table, video data of an initial gray scale, transient video data, and video data of measurement object gray scale are sequentially displayed on an LCD device. Simultaneously, an operator checks light change of an LCD device using by a measuring device to determine appropriate transient pixel data. The operator repeatedly performs the above-described image displaying operation while changing the gray scale of the transient video data several times with respect to an arbitrary gray scale. Transient pixel data are prepared for each gray scale by repeatedly performing the above-described a transient pixel data setting operation for each gray scale. Finally, the transient pixel data for each gray scale are mapped and stored in the form of an over-driving look-up table by an operator.

In the above described method, populating the over-driving look-up table of an LCD device depends on input of video data through an operator's manual operation and measurement of light change on an LC display panel. Setting the values for the over-driving look-up table requires a long period of time using the described manual method. In addition, the accuracy of transient pixel data is inevitably reduced due to an operator's inaccuracies in measuring a change in the light waveform detected using the measuring device, and there may be deviations in measurements obtained by different operators. In addition, the process of making or setting the over-driving look-up table for each LCD device is difficult.

SUMMARY OF THE INVENTION

Accordingly, the present invention is directed to an apparatus for automatically setting an over-driving look-up table for a liquid crystal device and a control method thereof that substantially obviates one or more of the problems due to limitations and disadvantages of the related art.

An advantage of the present invention is to provide an apparatus suitable for automatically generating an over-driving look-up table for a liquid crystal display device, and a control method thereof.

Another advantage of the present invention is to provide an over-driving look-up table automatic setting apparatus suitable for accurately setting an over-driving look-up table for a liquid crystal display device, and a control method thereof.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, an over-driving look-up table automatic setting apparatus for a liquid crystal display device includes: an input device that specifies a critical response condition for a liquid crystal display device; a sensor that detects an amount of light from the liquid crystal display device and that generates a signal corresponding to the amount of light; a response state detecting unit that measures the response state from the signal generated by the sensor; a controller that receives the response state for gray scale differences from each of a plurality of gray scale values to determine transient pixel data producing a response state that satisfies the critical response condition and that sets an over-driving look-up table by mapping the transient pixel data to corresponding gray scale difference values for each gray scale value; and a memory that stores the over-driving look-up table.

In another aspect of the present invention, a method of setting up an over-driving look-up table automatic setting apparatus for a liquid crystal display device includes: specifying a critical response condition for a liquid crystal display device; sensing an amount of light emitted from the display in response to a gray scale difference from a gray scale value and generating signal corresponding to the amount of light; determining a response state from the generated signal; determining transient pixel data that produce a response state satisfying the critical response condition upon display on the liquid crystal display device; and setting an over-driving look-up table by mapping the transient pixel data to the gray scale difference for the gray scale value.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification do not necessarily all refer to the same embodiment. Further, when a particular feature, structure, or characteristic is described in connection with any embodiment, it is submitted that it is within the purview of one skilled in the art to implement such a feature, structure, or characteristic in connection with other ones of the embodiments.

Hereinafter, reference in detail will be made to embodiments of the present invention, examples of which are illustrated in the accompanying drawings. Wherever possible, the same reference numbers will be used throughout the drawings to refer to the same or like parts.

Figure 1:
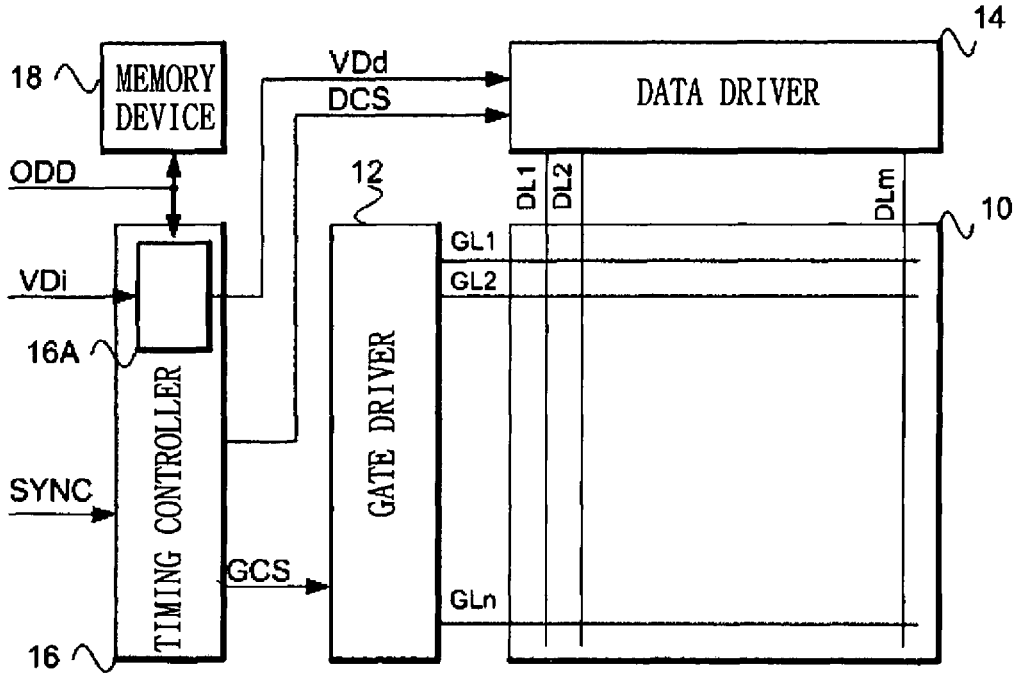
FIG. 1 is a schematic block diagram for an over-driving liquid crystal display device.

FIG. 1 is a schematic block diagram illustrating an over-driving liquid crystal display (LCD) device with which an over-driving look-up table setting apparatus for a liquid crystal display device according to embodiments of the invention may be used. The LCD device includes: a gate driver 12 and a data driver 14 electrically connected with an LC panel 10; a timing controller 16 for controlling the operations of the drivers 12 and 14; and a memory device 18 for storing a look-up table. Gate lines GL1-GLn and data lines DL1-DLm cross each other to define a plurality of pixel regions arranged in a matrix configuration on the LC panel 10. An LC pixel is formed in each of the plurality of pixel regions.

A gate driver 12 sequentially enables each of the gate lines GL1-GLn for a predetermined period (for example, a period of one horizontal synchronization signal) of one frame (period of one vertical synchronization signal). For this purpose, the gate driver 12 generates a plurality of gate signals exclusively having an enable pulse that are sequentially shifted for every period of a horizontal synchronization signal. The gate enable pulse contained in each of the gate signals has the same width as the period of a horizontal synchronization signal. The gate enable pulse for each of the gate signals is generated once by every frame period. To generate the plurality of gate signals, the gate driver 12 responds to gate control signals GCS from the timing controller 16. The gate control signals GCS include a gate start pulse GSP, and at least one gate clock GSC. The gate start pulse GSP maintains a predetermined logic (e.g., logic high) corresponding to a period of one horizontal synchronization signal from a start point of a frame period.

The data driver 14 generates pixel driving signals corresponding to the number of the data lines DL1-DLm (i.e., the number of LC pixels arranged on one gate line) whenever one of the gate lines GL1-GLn is enabled.

Each of data signals of one line segment is supplied to a corresponding LC pixel on the LC panel 10 via a corresponding data line DL. Each of the LC pixels arranged on the gate line GL transmits an amount of light corresponding to a voltage level of a corresponding pixel driving signal. To generate pixel driving signals for one line segment, the data driver 14 sequentially inputs pixel data VDd of one line segment for every period of an enable pulse contained in a gate signal in response to a data control signal DCS. The data driver 14 converts the sequentially input pixel data VDd of one line segment into analog pixel driving signals.

The timing controller 16 receives as input synchronization signals SYNC from an external video source (for example, an image demodulating module contained in a television receiver, or a graphic module contained in a computer system). The synchronization signals SYNC include a data clock Dclk, a data enable signal DE, a horizontal synchronization signal Hsync, and a vertical synchronization signal Vsync. The timing controller 16 generates gate control signals GCS using one or more signals of the synchronization signals SYNC. The gate control signals GCS are required for the gate driver 12 to generate the plurality of gate signals allowing the plurality of gate lines GL1-GLn on the LC panel 10 to be sequentially scanned during each frame. The timing controller 16 also generates data control signals DCS. The data control signals DCS allows the data driver 14 to sequentially input pixel data VDd of one line segment for every period in which a gate line GL is enabled to convert the sequentially input pixel data VDd of one line segment into analog pixel data signals, and to output the same. Furthermore, the timing controller 16 receives as input a pixel data stream VDi formed by a frame unit from a video source. The timing controller 16 divides a pixel data stream VDi of one frame into a pixel data stream VDd for line segments, and supplies the divided pixel data stream VDd of each line segment to the data driver 14.

The timing controller 16 includes an over-driving controller 16A. The over-driving controller 16A detects whether pixel data rearranged into a line segment is different from corresponding pixel data of a previous frame. In the case where pixel data of a current frame has a gray scale different from that of the corresponding pixel data of the previous frame, the over-driving controller 16A reads transient pixel data from an over-driving look-up table stored in the memory device 18 using the pixel data of the previous frame and the current frame as an address. The over-driving controller 16A allows the read transient pixel data to be supplied to the data driver 14 in place of the pixel data of the current frame. Accordingly, an LC pixel on the LC panel 10 allows the physical operation (e.g., rotating motion) of LC molecules to be performed at high speed in response to a transient pixel driving signal corresponding to the gray scale of transient pixel data from the data driver 14. To allow the physical operations of the LC molecules to be completed within a predetermined period regardless of gray scale fluctuation width (i.e., voltage fluctuation width of a pixel driving signal), transient pixel data is set to a value suitable for the property of liquid crystal, the design specification of an LCD device, and the model of the LCD device.

The memory device 18 is connected to the over-driving controller 16A within the timing controller 16 and is also connected to an external data source (for example, a computer system or an over-driving look-up table setting apparatus) via an integrated circuit (I2C) bus. The memory device 18 may be accessed by an external computer system or over-driving look-up table setting apparatus connected via the I2C bus, and may also be accessed by the timing controller 16 and the over-driving controller 16A inside the timing controller 16. The memory device 18 may store a look-up table provided from the external computer system or the over-driving look-up table setting apparatus. In addition, the memory device 18 retrieves transient pixel data from a storage region in the memory device corresponding to an address supplied from the over-driving controller 16A inside the timing controller 16 to retrieve the read transient pixel data to be supplied to the over-driving controller 16A.

Figure 2:
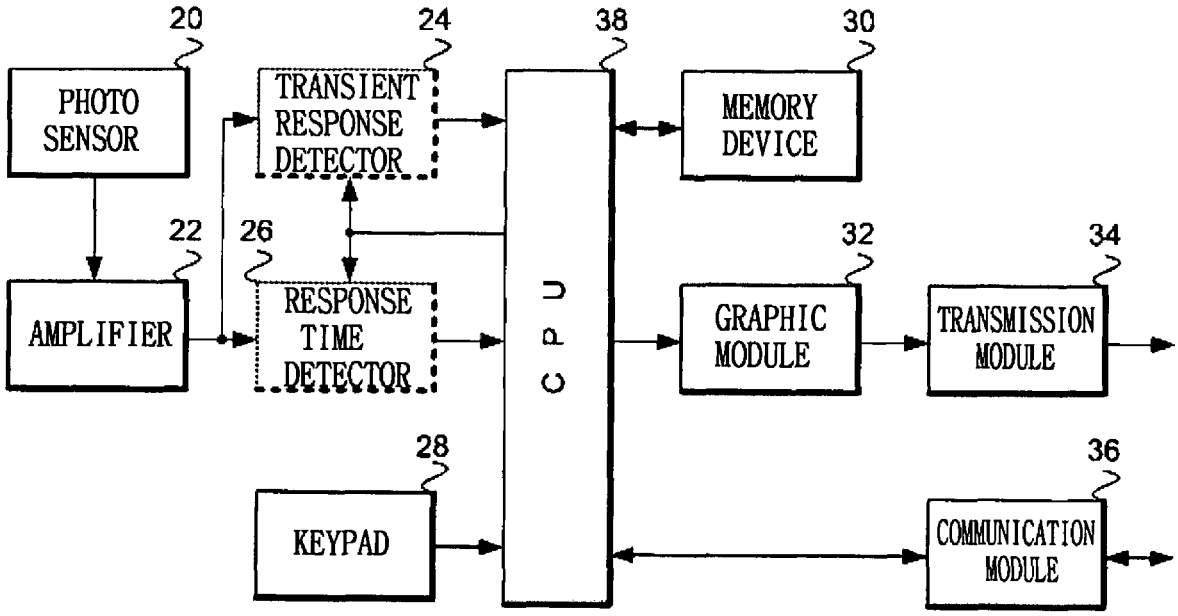
FIG. 2 is a block diagram of an apparatus for automatically setting an over-driving look-up table for a liquid crystal display device according to an embodiment of the invention.

FIG. 2 is a block diagram illustrating an apparatus for automatically setting an over-driving look-up table for a liquid crystal display device according to an embodiment of the invention. The apparatus of FIG. 2 includes a transient response detector 24, a response time detector 26, a keypad 28, a memory device 30, a graphic module 32, and a communication module 36, which are connected to a central processing unit (CPU) 38. The aforementioned components may be connected to a common bus coupled to the CPU 38.

The transient response detector 24 monitors a voltage waveform of a light detection signal input from a photo sensor 20 via an amplifier 22 to detect a transient response rate corresponding to the overshoot response rate for the LCD device of FIG. 1. A transient response rate detecting operation using the transient response detector 24 is performed for a predetermined period. The transient response rate detected by the transient response detector 24 is supplied to the CPU 38. The transient rate may be computed from the required time for the light detection signal to settle to within a predetermined percentage (e.g. within 2 percent) of the final value. The transient response detector 24 having this function may be realized by a program (i.e., software instructions) executed by the CPU 38.

The response time detector 26 monitors a voltage waveform of a light detection signal input from the photo sensor 20 via the amplifier 22 to detect a response time (or response speed) of the LCD device of FIG. 1. The response time detecting operation of the response time detector 26 is performed for a period controlled by the CPU 38. For example, the response time detector 26 may accumulate a count during a period until a light detection signal traverses values between a first arbitrary level (e.g. a level having a value 10% of the way between a starting value and final value for the light signal) and a second arbitrary (e.g. a level 90% of the way between the starting value and a final value for the light signal) to detect a response time of the LCD device. As described for the transient response detector 24, the response time detector 26 may be realized using a program (software instructions) executed by the CPU 38. Consequently, both the transient response detector 24 and the response time detector 26 may be implemented using software, in which case, the amplifier 22 may be directly connected to the CPU 38.

The photo sensor 20 is positioned to correspond to a specific LC pixel on the LC panel 10 of FIG. 1 and converts an amount of light emitted from the corresponding LC pixel into an electrical signal (i.e., voltage signal) as a light detection signal. The light detection signal output from the photo sensor 20 is amplified at a predetermined amplifying ratio by the amplifier 22, and then supplied to the transient response detector 24 and the response time detector 26.

The keypad 28 receives commands and data designated by a user and delivers the same to the CPU 38. The memory device 30 temporarily stores data that have been processed or are to be processed by the CPU 38, and also stores an initial over-driving look-up table, a look-up table form, an arbitrary transient list, a list of transient pixel data for each gray scale difference, as well as other data related to setting the over driving look-up table. In addition, the memory device 30 may store the programs for carrying out the processes illustrated in FIGS. 3 and 4 when executed using the CPU 38 to set up the look-up table. The graphic module 32 generates video data and synchronization signals allowing image data processed by the CPU 38 to be displayed on a display panel (e.g., the LC panel 10 shown in FIG. 1). Video data generated by the graphic module 32 are supplied to the timing controller 16 of FIG. 1 via a transmission module 34 together with synchronization signals SYNC. The communication module 36 is used to transmit a look-up table from the CPU 38 to the memory device 18 inside the LCD device, or to transmit a look-up table read from the memory device 18 inside the LCD device to the CPU 38.

When a look-up table setting command is received as input from the keypad 28, the CPU 38 receives response condition data prescribing a target response time RTt and a critical over-shooting response rate OSc. The CPU 38 reads an initial over-driving look-up table stored in the memory device 30, and loads the read initial over-driving look-up table into the memory device 18 of the LCD device of FIG. 1 via the communication module 36. The initial over-driving look-up table uses gray scale levels of an image as row and column addresses and includes initial-transient pixel data of normal gray scale stored in storage regions designated by these addresses. The initial-transient pixel data is set to have the same logic value of one (for example, a column address) of row and column addresses regardless of the other (for example, a row address) of the row and column addresses. For example, in the case where pixel data of a previous frame corresponds to a row address and pixel data of a current frame corresponds to a column address, gray scales of initial-transient pixel data stored in the initial over-driving look-up table have the same values as the logic values of column addresses. In other words, the initial-transient pixel data stored in the initial over-driving look-up table have the same gray scale value in a row direction, and have gray scales increasing by one in a column direction. As a result, the LCD device of FIG. 1 performs a normal operation directly displaying video data without over-driving using the initial over-driving look-up table.

While response condition data is described above as being received via keypad input, other means of receiving input for specifying the response condition data, may be used. For example, an input device (e.g. a bar code scanner) may read an identifier (e.g. a barcode identifier) provided with a liquid crystal display device, where the identifier specifies the model and type for the liquid crystal display device, and corresponding response condition data for the model and type of the liquid crystal display device may be retrieved from a table.

The CPU 38 allows reference image data, transient image data, and image data for measurement to be sequentially and repeatedly displayed by the LCD device while changing gray scales of transient image data for each gray scale difference to monitor a response state (i.e., transient response and response time) of the LCD device on the basis of input response condition. The reference image data, transient image data, and image data for measurement output from the CPU 38 are sequentially supplied to the timing controller 16 of the LCD device of FIG. 1 via the graphic module 32 and the transmission module 34, and thus sequentially displayed on the LC panel 10. The reference image data and the image data for measurement are displayed by the predetermined number of times (or a predetermined period, i.e., period of ten frames), but the transient image data is displayed only once (i.e., for only one frame period). The CPU 38 determines transient pixel data for each gray scale difference satisfying response condition data of the LCD device for each gray scale difference of an image through the operation of measuring transient image data. The transient pixel data for each gray scale difference is written by the CPU 38 on a list (referred to as an Over Driving list for each gray scale difference) of transient pixel data for each gray scale difference onto the memory device 30.

The above-determined transient pixel data for each gray scale difference are mapped by the CPU 38 to a look-up table form using the gray scale levels of an image as row and column addresses, so that an over-driving look-up table is generated. One of the row and column addresses corresponds to gray scale of pixel data of a previous frame, and the other of the row and column addresses corresponds to gray scale of pixel data of a current frame. After the over-driving look-up table is loaded on the memory device 18 of the LCD device of FIG. 1, the LCD device allows input video data to be displayed on the LC panel 10 in an over-driving manner. Accordingly, not only is the response time of the LCD device improved, but also a motion blurring and a ghosting may be reduced or eliminated. Consequently, the LCD device can provide improved image quality.

The operation of measuring the transient pixel data may be performed by the CPU 38 for each predetermined gray scale difference (at least 2-gray scale level difference) rather than for each gray scale value. In this case, the time consumed by the CPU 38 performing the operation of measuring the transient pixel data may be reduced to ½ or less. The CPU 38 performs an interpolation operation of transient pixel data for each predetermined gray scale difference to obtain values for the unmeasured gray scales.

The interpolation operation of the transient pixel data for each predetermined gray scale difference generates transient pixel data for respective gray scale differences on which the operation of measuring the transient pixel data has not been performed to insert the generated transient pixel data between transient pixel data for each predetermined gray scale difference. The above-formed transient pixel data for each gray scale difference are mapped by the CPU 38, so that the complete over-driving look-up table for an LCD device is set (or made).

The operation of measuring the transient pixel data may be configured to allow transient pixel data that satisfies first a critical transient response rate OSc to be detected (or set), or allow transient pixel data that satisfies first a target response time RTt to be detected (or set). A gray scale of transient pixel data by the former measurement operation allows the LCD device to have a transient response characteristic of less than a critical transient response rate OSc while allowing the LCD device to have a response time longer (or slower) than the target response time (or speed) depending on a gray scale difference. In this case, the gray scale of a portion of transient pixel data for each gray scale difference that do not satisfy the target response time (or speed) can be controlled (compensated for) such that the target response time thereof can be satisfied by designation of an operator. Meanwhile, transient pixel data by the latter measurement operation may allow the LCD device to have a response time equal to or shorter than the target response time (or speed), while allowing the LCD device to have a response characteristic greater than a critical transient response rate depending on a gray scale difference. Therefore, gray scales of a portion of transient pixel data by the latter measurement operation that allows the LCD device to have a response characteristic greater than a critical transient response rate have a response characteristic less than the critical transient response rate by designation by the operator, and thus can be controlled (or compensated for). Gray scales of pixel data for measurement corresponding to transient pixel data that do not satisfy a response time by the former case, and transient pixel data that do not satisfy the critical transient response rate by the latter case are written by the CPU 38 on a critical transient list on the memory device 30.

Figure 3:
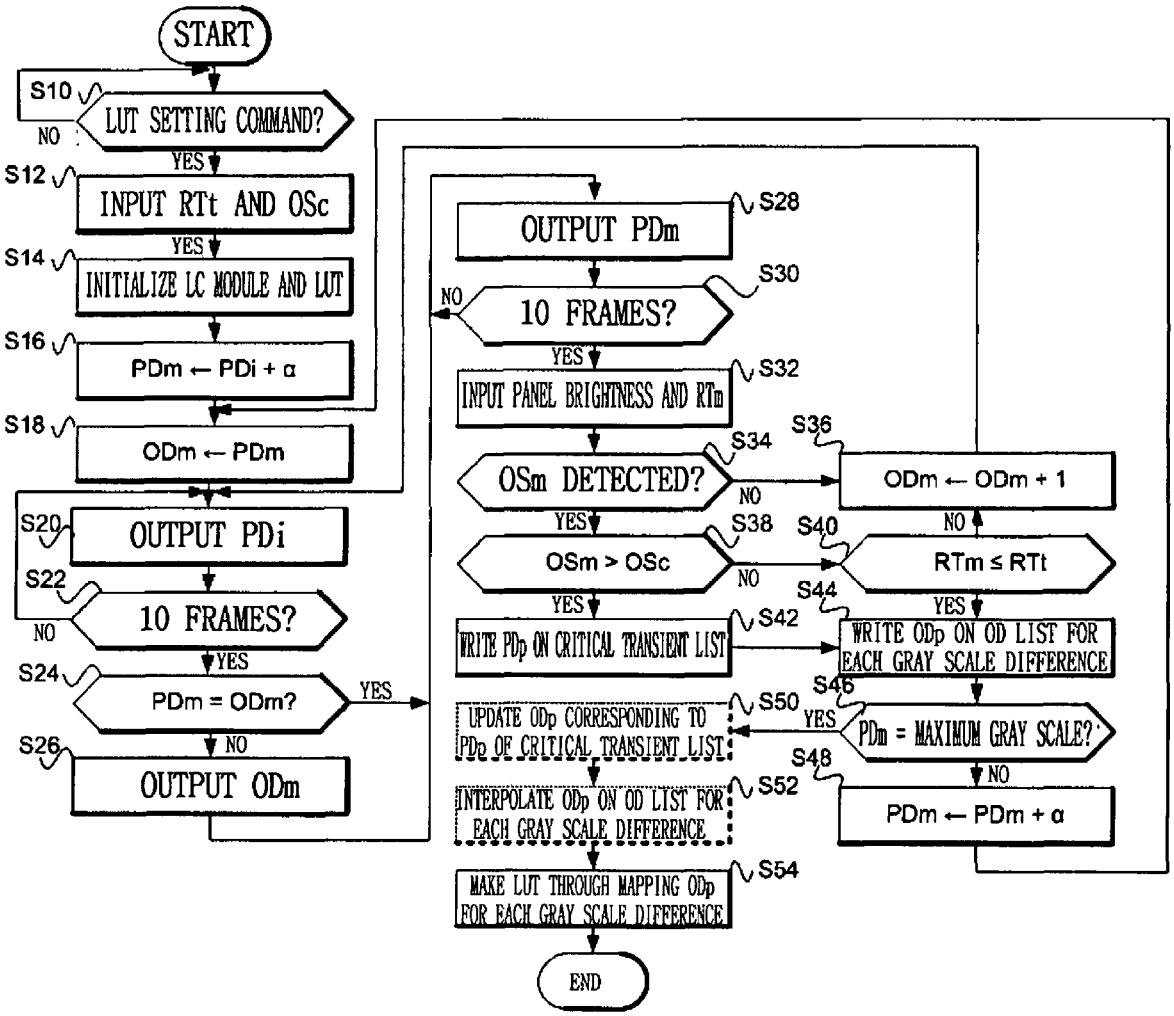
FIG. 3 is a flowchart illustrating a method for controlling an apparatus for automatically setting an over-driving look-up table for a liquid crystal display device according to an embodiment of the invention.
Figure 4:
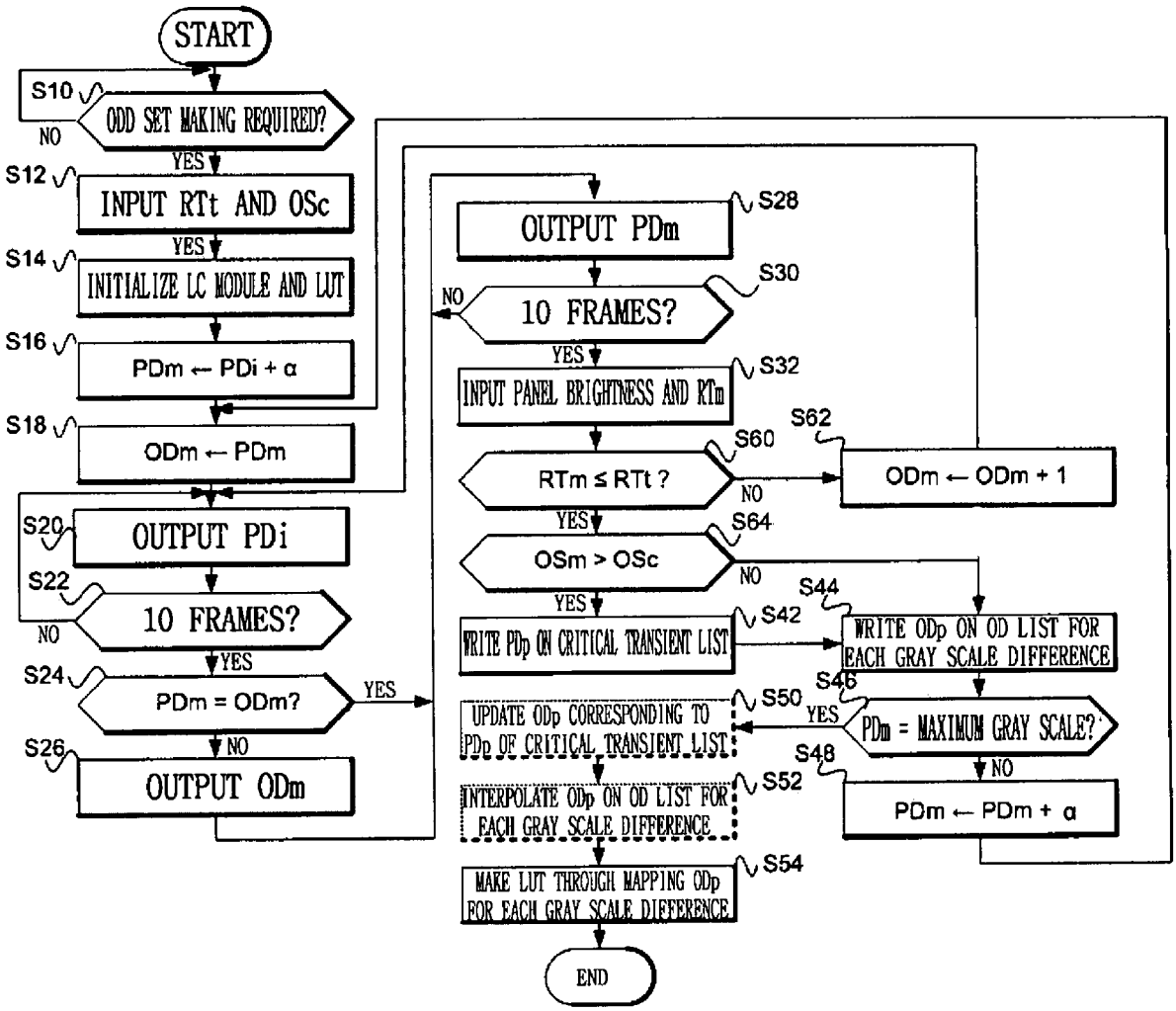
FIG. 4 is a flowchart illustrating a method for controlling an apparatus for automatically setting an over-driving look-up table for a liquid crystal display device according to another embodiment.

The operation of setting the look-up table for an LCD device performed by the CPU 38 can be performed as illustrated in the flowcharts of FIGS. 3 and 4. The CPU 38 controls the transient response detector 24, the response time detector 26, the keypad 28, the memory device 30, the graphic module 32, transmission module 34, and the communication module 36.

As described above, the apparatus for automatically setting the look-up table for the LCD device according to an embodiment suitably detects gray scales of transient pixel data for each gray scale difference for a response condition of the LCD device required by the operator or developer, and maps the gray scales of the transient pixel data for each gray scale difference in the form of a table, thereby automatically setting the look-up table for the LCD device. Accordingly, the look-up table for the LCD device can be easily and quickly set. In addition, in the apparatus for automatically setting the look-up table for the LCD device according to an embodiment, a response state of the LCD device is evaluated using a hardware and/or software. Accordingly, transient pixel data on the look-up table for the LCD device can be accurately set even when the physical properties, design specification, and a model of the LCD device change.

FIG. 3 is a flowchart illustrating a method for controlling an apparatus for automatically setting an over-driving look-up table for a liquid crystal display device according to an embodiment of the invention. The process illustrated in flowchart of FIG. 3 may be performed by software instructions executed by CPU 38 of FIG. 2. Therefore, the flowchart of FIG. 3 will be described in detail with reference to the apparatus of FIG. 2, for automatically setting the look-up table for the LCD device.

In operation S10, the CPU 38 stands by until a look-up table setting command is input from the keypad 28. The look-up table setting command is generated through operator input using the keypad 28. When a look-up table setting command is received, the CPU 38 selects response condition data including a target response time RTt and a critical transient response rate OSc designated by a user (S12). The CPU 38 reads an initial look-up table stored in the memory device 30, and allows the read initial look-up table to be stored in the memory device 18 of the LCD device of FIG. 1 via the communication module 36 (S14). Transient response data written on the initial look-up table have the same value as the gray scales of video data used to retrieve the transient response data. Because pixel data contained in the initial look-up table allow gray scales of video data to be directly output, the LCD device is allowed to perform a normal operation without over-driving to set a look-up table. Consequently, storing of the initial look-up table allows the LCD device to perform a normal, non-overdriving operation.

The CPU 38 sets the gray scale of image data for measurement PDm to a value obtained by adding a predetermined gray scale jump value α to the gray scale of reference image data PDi (S16). Transient image data ODm is set to have the same gray scale as that of the image data for measurement (S18). The gray scale of the reference image data PDi may be the gray scale corresponding to the color black. The gray scale jump value α determines the measurement frequency of transient pixel data. When the gray scale jump value α is small, the measurement frequency of transient pixel data increases. When the gray scale jump value α is large, the measurement frequency of transient pixel data decreases. In this aspect, the gray scale jump value α can be set to an integers between 1 and a number corresponding to half of the number of gray scales for an image. To minimize a look-up table making time while maintaining the accuracy of transient pixel data, the gray scale jump value α may be set to an integer from 2 to 10. For example, the gray scale jump value α may be set to "5". Assuming that the number of gray scales of an image is 256 and the gray scale jump value α is "5", the reference image data PDi has gray scale of "0", both the gray scales of the image data PDm for first measurement and over-driving pixel data become "5". In operation S20, the CPU 38 supplies the reference image data PDi to the graphic module 32. The CPU 38 enables detecting operations of the transient response detector 24 and the response time detector 26. The graphic module 32 allows the reference pixel data PDi to correspond to LC pixels on the LC panel 10 to generate video data for a reference image. The video data for the reference image generated by the graphic module 32 are supplied to the timing controller 16 of FIG. 1 via the transmission module 34 together with synchronization signals (i.e., vertical synchronization signal Vsync, horizontal synchronization signal Hsync, data clock Dclk, and data enable signal DE. Video data for a reference image allow predetermined color (for example, black) to be displayed on the LC panel 10. The CPU 38 stands by until the video data for the reference image is output for a predetermined time (for example, period of 10 frames) (S22). When it is judged that the video data for the reference image is output for the predetermined time (i.e., the period of 10 frames), the CPU 38 examines whether the gray scale of image data for measurement PDm is the same as that of transient image data ODm (S24). When the gray scale of the image data PDm for measurement is different from that of the transient image data ODm, the CPU 38 supplies the transient image data ODm to the graphic module 32 to allow video data for a transient image to be supplied from the graphic module 32 to the timing controller 16 of FIG. 1 together with synchronization signals via the transmission module 34 (S26). At this point, the LC panel 10 displays video data for the transient image. When the gray scale of the image data for measurement is the same as that of the transient image data ODm after the operation S26 or in the operation S24, the CPU 38 supplies the image data PDm for measurement to the graphic module 32 (S28). The graphic module 32 allows the image data PDm for measurement to correspond to the LC pixels on the LC panel 10 to generate video data for measurement image. The video data for the measurement image generated by the graphic module 32 are supplied to the timing controller 16 of FIG. 1 together with synchronization signals via the transmission module 34. At this point, the LC panel 10 displays predetermined color corresponding to the gray scale of the video data for measurement image. After the image for measurement starts to display, the CPU 38 stands by until a predetermined time (for example, period of 10 frames) elapses (S30).

When it is judged that the displaying of the image for measurement for the predetermined time (i.e., period of 10 frames) in the operation S30 is complete, the CPU 38 inputs a transient response rate OSm detected by the transient response detector 24 and a response time RTm detected by the response time detector 26 (S32). The CPU 38 examines whether the detected transient response rate OSm is "0" or more to detect the transient response. If it is judged that there is no transient response in the operation S34, the CPU 38 increases the gray scale of the transient image data ODm by an increment of "1" (S36). After the operation S36, the CPU 38 returns to operation S20 and re-performs the operations S20 to S34 using the increased transient image data ODm.

When it is judged that there is a transient response in the operation S34, the CPU 38 examines whether the detected transient response rate OSm is greater than a critical transient response rate OSc (S38). When the detected transient response rate OSm is less than or equal to the critical transient response rate OSc in the operation S38, the CPU 38 examines whether the detected response time RTm is shorter or equal to the target response time RTt (S42). When the detected response time RTm is longer than the target response time RTt in the operation S42, the CPU 38 returns to the operation S36 to increment ODm and to perform the operations S20 to S40.

When the detected transient response rate OSm is greater than the critical transient response rate OSc in the operation S38, the gray scale of image data for measurement (i.e., pixel data for measurement PDp) is written on a critical transient list on the memory device 30, so that it is displayed that abnormal transient pixel data ODp is prepared (S42). After the operation S38 is performed, or when the detected response time RTm is shorter than or equal to the target response time RTt in the operation S40, the CPU 38 records the gray scale of transient image data as transient pixel data ODp in a storage region corresponding to the gray scale of the image data for measurement PDm on an OD list for each gray scale difference on the memory device 30 (S44). Subsequently, the CPU 38 examines whether the gray scale of the image data for measurement PDm is a maximum gray scale of gray scale set of an image (S46). When the gray scale of the image data for measurement PDm is smaller than the maximum gray scale of the gray scale set of the image in the operation S46, the CPU 38 judges that there is an additional measurement of transient pixel data ODp to be performed and increases the gray scale of the image data PDm for measurement by the jump gray scale a (S48). After the operation S48 is performed, the CPU 38 returns to the operation S18 to perform again the operations S18 to S46. With respect to a portion of transient pixel data for each gray scale difference ODp, the response time (or speed) of the LCD device can be longer (or slower) than the reference response time (or speed). This is because measurement of transient pixel data for each gray scale difference is performed prior to the evaluation for the critical transient response rate OSc.

Once the gray scale of the image data for measurement PDm is equal to the maximum gray scale of the gray scale set of the image in the operation S46, the CPU 38 judges that measurement (or making) of the transient pixel data ODp for each predetermined gray scale difference of the image has been completed. The CPU continues from operation S50 to compensate and update the gray scales of the transient pixel data ODp on the OD list for each gray scale difference corresponding to the pixel data PDp for measurement on the critical transient list by a compensation rate designated by an operator. The gray scales of a portion of transient pixel data ODp that do not satisfy the response time (or speed) of the LCD device can be compensated for by the compensation and updating operation such that the gray scales of the portion of the transient pixel data ODp satisfy the response time (or speed) of the LCD device. The operation S50 for re-controlling the transient image data can be omitted. Subsequently, the CPU 38 interpolates and generates transient pixel data ODp with respect to gray scale differences that have not been measured using the measured transient pixel data ODp on the OD list for each gray scale difference stored in the memory device 30 (S52). All of the transient pixel data ODp for each gray scale difference are written on the OD list for each gray scale difference by the interpolation operation. In the case where the gray scale of the image data PDm for measurement increases by "1" (i.e., when the measurement operation of the transient pixel data ODp is performed for each gray scale difference), the interpolation operation of the transient pixel data ODp (i.e., operation S52) is omitted.

The CPU 38 maps the transient pixel data on the OD list for each gray scale difference to the look-up table form stored in the memory device 30 to set (or make) an over-driving look-up table for an LCD device (S54). The look-up table form includes storage regions corresponding to row and column addresses. The row and column addresses correspond to the number of the gray scales of the image. One of the row and column addresses corresponds to the gray scale of pixel data of a previous frame, and the other of the row and column addresses corresponds to the gray scale of pixel data of a current frame. The transient pixel data on the OD list for each gray scale difference are written by the CPU 38 on the storage regions, respectively, determined by the row and column addresses, so that the over-driving look-up table for the LCD device is set (or made) completely.

The above set over-driving look-up table for the LCD device is stored by the CPU 38 in the memory device 30. The look-up table for the LCD device stored in the memory device 30 is read by the CPU 38 and loaded on the memory device 18 of the LCD device of FIG. 1 via the communication module 36 whenever a loading command of an operator or a developer is input to the CPU 38 through the keypad 28. As the over-driving look-up table is loaded on the memory device 18 of the LCD device of FIG. 1, the LCD device allows input video data to be displayed on the LC panel 10 in an over-driving manner. Accordingly, not only is the response time of the LCD device improved, but also a motion blurring phenomenon and a ghost phenomenon are minimized. Consequently, the LCD device can provide improved image quality.

As described above, the method for controlling the apparatus for automatically setting the look-up table for the LCD device according to an embodiment allows the controller (i.e., the CPU 38) to detect the gray scale of transient pixel data for each gray scale difference satisfying the response time (or speed) within a range that primarily satisfies the critical transient response rate of the LCD device required by the operator or developer, and to map the gray scales of transient pixel data for each gray scale difference in the form of a table, thereby automatically setting the look-up table for the LCD device. Accordingly, the look-up table for the LCD device can be set easily and fast. Also, in the method for controlling the apparatus for automatically setting the look-up table for the LCD device according to an embodiment, the response state of the LCD device is automatically judged by a software block. Accordingly, transient pixel data on the look-up table for the LCD device can be accurately set even when the physical properties, design specification, and a model of the LCD device change.

FIG. 4 is a flowchart explaining step by step a method for controlling an apparatus for automatically setting an over-driving look-up table for a liquid crystal display device according to another embodiment. The flowchart of FIG. 4 will be described with reference to the apparatus illustrated in FIG. 2 because the process illustrated in the flowchart of FIG. 4 may be performed by the CPU 38 of FIG. 2 in the same way described for the method illustrated in the flowchart of FIG. 3.

The flowchart of FIG. 4 includes the same sequences as those of the flowchart of FIG. 3 except that operations S60 to S66 are included instead of the operations S34 to S40. Accordingly, a detailed description of event sequences for the operations in FIG. 4 that are the same as those described with reference to FIG. 3 has been omitted.

After the operation S32 is performed, the CPU 38 examines whether the detected response time RTm is shorter than or equal to the target response time RTt (S60). When the detected response time RTm is longer than the target response time RTt in the operation S60, the CPU 38 increases the gray scale of the transient image data ODm by "1" (S62). After the operation S62, the CPU 38 returns to operation S20 to perform again the operations S20 to S32, and S60 to repeat the measurement operation of the transient pixel data ODp. When the detected response time RTm is shorter than or equal to the target response time RTt in the operation S60, the CPU 38 examines whether the detected transient response rate OSm is greater than the critical transient response rate OSc (S64). When the detected transient response rate OSm is greater than the critical transient response rate OSc in the operation S64, the CPU 38 performs the operation S42. In the operation S42, the CPU 38 displays abnormal pixel data ODp has been set (or made) by writing the gray scale of image data for measurement as pixel data for measurement PDp on the critical transient list on the memory device 30. After the operation S42 is performed, or when the detected transient response rate OSm is smaller than or equal to the critical transient response rate OSc in the operation S64, the CPU 38 performs the operation S44. In the operation S44, the CPU 38 records the gray scale of transient image data as transient pixel data ODp in a storage region corresponding to the gray scale of the pixel data PDp for measurement on the OD list for each gray scale difference on the memory device 30. The above-made transient pixel data on the OD list for each gray scale difference may include transient pixel data having a characteristic that the transient response characteristic of the LCD device does not satisfy the critical transient response rate. This is because the measurement operation of the transient pixel data is performed to satisfy the reference response time (or speed) before the evaluation of the response rate. To compensate for and update transient pixel data on the OD list for each gray scale difference that do not satisfy the transient response characteristic of the LCD device, the CPU 38 can perform the operation S50. In the operation S50, the CPU 38 performs the compensation operation such that the gray scales of a portion of the transient pixel data ODp that do not satisfy the transient response characteristic of the LCD device satisfy the transient response characteristic of the LCD device on the basis of a compensation rate input by a user or operator using the keypad 28.

As described above, the method for controlling the apparatus for automatically setting the look-up table for the LCD device according to an embodiment allows the controller (i.e., the CPU 38) to detect the gray scale of transient pixel data for each gray scale difference satisfying the critical transient response rate within a range that primarily satisfies the reference response time (or speed) of the LCD device required by the operator or developer, and to map the gray scales of transient pixel data for each gray scale difference in the form of a table, thereby automatically setting the look-up table for the LCD device. Accordingly, the look-up table for the LCD device can be easily and quickly set. In the method for controlling the apparatus for automatically setting the look-up table for the LCD device according to the described embodiments, the response state of the LCD device may be automatically judged by a software block. Accordingly, transient pixel data on the look-up table for the LCD device may be accurately set even when the physical properties of the liquid crystal, and the design specification and model of the LCD device are varied.

Figure 5:
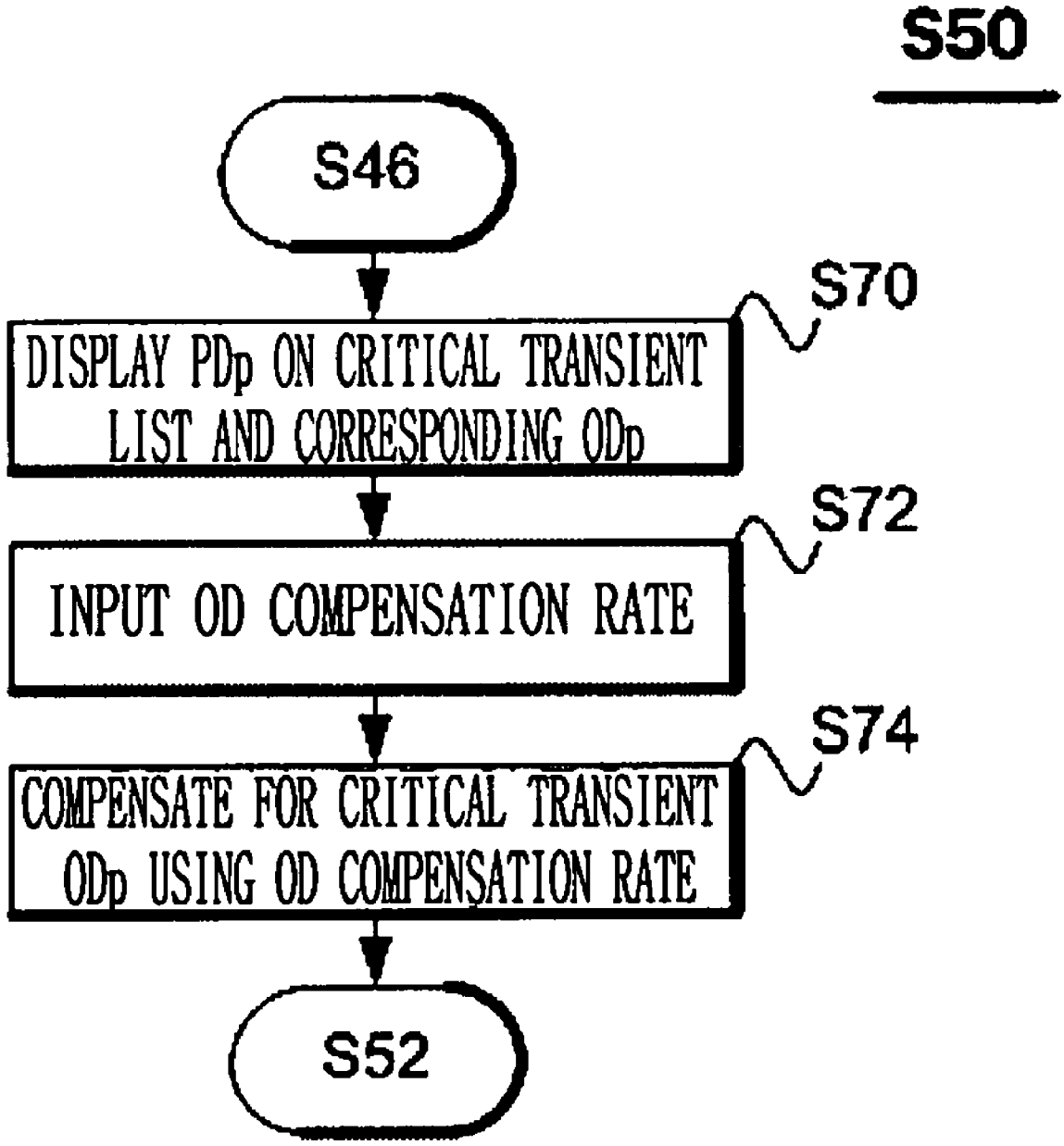
FIG. 5 is a flowchart illustrating details of the processes of updating an over-driving data for a critical transient response illustrated in FIGS. 3 and 4.

FIG. 5 is a flowchart illustrating in more detail the operation S50 of re-controlling of transient pixel data ODp of the critical transient response shown in FIGS. 3 and 4. The flowchart of FIG. 5 will be described with reference to FIG. 2 because the process illustrated in flowchart of FIG. 5 may be performed by the CPU 38 shown in FIG. 2.

When the gray scale of the image data PDm for measurement has a maximum gray scale of a gray scale set of an image in the operation S46, the CPU 38 supplies pixel data for measurement PDp on the critical transient list on the memory device 30 and corresponding pixel data ODp on the OD list for each gray scale difference in the form of video data to the timing controller 16 of FIG. 1 via the graphic module 32 and the transmission module 34 (S70). At this point, abnormally set transient pixel data ODp and corresponding pixel data PDp for measurement are displayed on the LC panel 10 of the LCD device. The CPU 38 receives a compensation value of transient pixel data ODp designated by the operator (or developer) using the keypad 28 (S72). The gray scale of abnormally set transient pixel data ODp on the OD list for each gray scale difference is compensated for and updated on the basis of the received compensation value (S74). The gray scale of the compensated and updated transient pixel data ODp is decreased or increased such that the gray scale of the compensated and updated transient pixel data ODp satisfies the critical transient response rate or the reference response time (or speed) of the LCD device.

As described above, the apparatus for automatically setting the look-up table for the LCD device and the control method thereof according to an embodiment detect the gray scale of transient pixel data for each gray scale difference suitably for a response condition of the LCD device required by the operator or developer, and maps the gray scales of transient pixel data for each gray scale difference in the form of a table, thereby automatically setting the look-up table for the LCD device. Accordingly, the look-up table for the LCD device may be easily and quickly set. Additionally, in the method for controlling the apparatus for automatically setting the look-up table for the LCD device according to an embodiment, the response state of the LCD device may be automatically judged using a software operation. Accordingly, transient pixel data on the look-up table for the LCD device may be accurately set even when the physical properties, design specification, and the model of the LCD device are changed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An over-driving look-up table automatic setting apparatus for a liquid crystal display device, the apparatus comprising:

an input device that specifies a critical response condition for the liquid crystal display device;

a sensor that detects an amount of light from the liquid crystal display device and that generates a signal corresponding to the amount of light;

a response state detecting unit that measures a response state from the signal generated by the sensor;

a controller that receives the response state for gray scale differences from each of a plurality of gray scale values to determine transient pixel data producing the response state that satisfies the critical response condition and that sets an over-driving look-up table by mapping the transient pixel data to the corresponding gray scale differences for each of the gray scale values; and a memory that stores the over-driving table look-up table, wherein the controller allows reference image data, transient image data and image data for measurement to be sequentially and repeatedly displayed by the liquid crystal display device and monitors the response state of the liquid crystal display device, wherein the response state detecting unit includes a transient response detector that measures a transient response rate of the signal from the sensor and a response time detector that measures a transient response time of the signal from the sensor, wherein the critical response condition includes data specifying a critical transient response rate and a critical response time for the liquid crystal display device, and wherein the critical response condition includes a designation data identifying one of the critical transient response rate and the critical response time as a primary critical response condition.

2. The apparatus according to claim 1, wherein the controller determines the transient pixel data satisfying the critical transient response time for each of the gray scale differences.

3. The apparatus according to claim 2, wherein the controller compensates the transient pixel data not satisfying the critical transient response rate for each of the gray scale differences.

4. The apparatus according to claim 1, wherein the controller determines the transient pixel data satisfying the critical transient response rate for each of the gray scale differences.

5. The apparatus according to claim 4, wherein the controller compensates the transient pixel data not satisfying the critical transient response time for each of the gray scale differences.

6. The apparatus according to claim 1, further comprising:

a graphics module that receives image data from the controller and that outputs the image data with synchronization signals for display on the liquid crystal display device.

7. The apparatus according to claim 1, wherein the controller determines the transient pixel data by measuring the response state for the gray scale differences from the gray scale values separated by a predetermined interval between the minimum and the maximum of the gray scale values where the predetermined interval is an integer greater than or equal to two.

8. The apparatus according to claim 7, wherein the controller determines the transient pixel data for the gray scale differences corresponding to the gray scale values within the predetermined intervals between the gray scale values using interpolation.

9. A method of setting up an over-driving look-up table for a liquid crystal display device, the method comprising:

specifying a critical response condition for the liquid crystal display device;

sensing an amount of light emitted from the liquid crystal display device in response to a gray scale difference from a gray scale value and generating a signal corresponding to the amount of light;

determining a response state from the generated signal;

determining transient pixel data that produce the response state satisfying the critical response condition upon displaying on the liquid crystal display device;

setting an over-driving look-up table by mapping the transient pixel data to the gray scale difference for the gray scale value; and allowing reference image data, transient image data and image data for measurement to be sequentially and repeatedly displayed by the liquid crystal display device and monitoring the response state of the liquid crystal display device by a controller, wherein determining the response state from the generated signal includes measuring a transient response rate of the signal from the sensor and measuring a transient response time of the signal from the sensor, wherein the critical response condition includes data specifying a critical transient response rate and a critical response time for the liquid crystal display device, and wherein the critical response condition includes a designation data identifying one of the critical transient response rate and the critical response time as a primary critical response condition.

10. The method according to claim 9, wherein determining the transient pixel data that produce the response state satisfying the critical response condition includes determining the transient pixel data satisfying the critical transient response time for the gray scale difference.

11. The method according to claim 10, wherein determining the transient pixel data that produce the response state satisfying the critical response condition further includes compensating the transient pixel data not satisfying the critical transient response rate for the gray scale difference.

12. The method according to claim 9, wherein determining the transient pixel data that produce the response state satisfying the critical response condition includes determining the transient pixel data satisfying the critical transient response rate for the gray scale difference.

13. The method according to claim 12, wherein determining the transient pixel data that produce the response state satisfying the critical response condition further includes compensating the transient pixel data not satisfying the critical transient response time for the gray scale difference.

14. The method according to claim 9, further comprising outputting image data corresponding to the gray scale difference for the gray scale value with synchronization signals for display on the liquid crystal display device.

* * * * *